US006302042B1

(12) United States Patent
Biedenweg et al.

(10) Patent No.: US 6,302,042 B1
(45) Date of Patent: Oct. 16, 2001

(54) DECK SUPPORT BRACKET FOR PONTOON CRAFT

(75) Inventors: Baron R. Biedenweg; Jerome Ruda, both of Fort Wayne, IN (US)

(73) Assignee: Harris Kayot, Inc., Fort Wayne, IN (US)

( * ) Notice: Subject to any disclaimer, the term of this patent is extended or adjusted under 35 U.S.C. 154(b) by 0 days.

(21) Appl. No.: 09/234,862

(22) Filed: Jan. 22, 1999

(51) Int. Cl.[7] ..... B63B 1/00; B63B 3/48
(52) U.S. Cl. ..... 114/61.22; 114/85; 114/292
(58) Field of Search ..... 114/61.1, 61.22, 114/123, 249, 264, 265, 266, 267, 283, 292, 85, 345

(56) References Cited

U.S. PATENT DOCUMENTS

| | | | | |
|---|---|---|---|---|
| 3,045,263 | * | 7/1962 | Blachly | 114/283 |
| 3,630,163 | * | 12/1971 | Williams | 114/85 |
| 3,807,338 | * | 4/1974 | Shader | 114/60 |
| 3,857,352 | | 12/1974 | Schott | 114/61.2 |
| 4,318,700 | * | 3/1982 | Price | 440/26 |
| 4,562,786 | * | 1/1986 | Pruonto | 114/61.22 |
| 4,738,215 | | 4/1988 | McMahon | 114/219 |
| 4,892,052 | * | 1/1990 | Zook et al. | 114/85 |
| 4,936,801 | * | 6/1990 | Herrit | 440/12 |
| 4,966,091 | * | 10/1990 | De Suarez D'Aulan | 114/345 |
| 4,993,350 | * | 2/1991 | Pepper | 114/292 |
| 5,509,563 | * | 4/1996 | Jolly | 220/221 |
| 5,784,980 | * | 7/1998 | Benefiel | 114/263 |
| 5,784,997 | * | 7/1998 | Schell et al. | 114/61.32 |

FOREIGN PATENT DOCUMENTS

| | | | |
|---|---|---|---|
| 25 10 507 | | 9/1976 | (DE) . |
| 29 48 557 | | 5/1981 | (DE) . |
| 262 839 | | 12/1988 | (DE) . |
| 2 232 935 | | 1/1991 | (GB) . |
| 63-258288 | | 10/1988 | (JP) . |
| 6-270886 | * | 9/1994 | (JP) ..... 114/61.1 |
| WO 92/21556 | | 10/1992 | (WO) . |

OTHER PUBLICATIONS

1998 Product Catalog for Harris Kayot, Inc.

* cited by examiner

*Primary Examiner*—S. Joseph Morano
*Assistant Examiner*—Andrew Wright
(74) *Attorney, Agent, or Firm*—Baker & Daniels

(57) ABSTRACT

A pontoon craft such as a vessel, a floating platform or a floating dock, having at least two pontoons, a deck extending between two of the pontoons, an elongate deck support bracket attached to a pontoon and having a first longitudinal slot which extends substantially the entire length of the bracket, and a fastener extending through the first slot and having a variable position therealong, wherein the deck is connected to the bracket by means of the fastener. The present invention also provides a pontoon craft having at least two pontoons, a deck extending between two of the pontoons, an elongate deck support bracket having a second longitudinal slot and attached to a surface of a pontoon at a joint, and an elongate trim member disposed in the second slot, the trim member depending from the second slot and covering the joint, whereby the joint is hidden from view.

37 Claims, 3 Drawing Sheets

DECK SUPPORT BRACKET FOR PONTOON CRAFT

BACKGROUND OF THE INVENTION

The invention relates to a floating pontoon craft, such as a pontoon boat, and particularly to a bracket for supporting the deck thereof. Herein, a pontoon craft according to the present invention encompasses not only vessels such as boats, but also includes floating swimming/diving and/or work platforms, and floating docks to which vessels may be secured. The deck support bracket, which is usually made from extruded aluminum, is normally attached to the outer surface of a pontoon and underlies the deck, which extends between two parallel pontoons which are, in general, elongate hollow members which may be cylindrical and are usually made of aluminum.

Pontoon craft, and the pontoons therefor, are available in various lengths. For example, a single manufacturer may produce pontoon boats of similar design in 20, 22, 24 and 28 foot lengths. The decks of pontoon craft, which extend between the pontoons, are typically formed from standard sized sheets of wooden plyboard and extend substantially over the entire length of the pontoons. Previous pontoon boats have, intermediate the pontoons and the deck, a plurality of individual deck support brackets, which are typically short aluminum extrusions having a somewhat inverted U-shaped cross-section. These individual, discrete, short deck support brackets are distributed, perhaps at irregular intervals, along the lengths of the generally inboard and outboard sides or edges of the longitudinal upper surface of each pontoon. The inboard and outboard deck support brackets are aligned across the boat in a direction transverse to the longitudinal axes of the pontoons, at various positions along the length of the boat. Thus, in sectional views taken across the width of a pontoon boat having two pontoons, at various locations along the boat's length, it would be seen that the inboard brackets are adjacent one another, separated by the distance between the pontoons, and lie between the two outboard brackets. Each of these four brackets is provided with an aperture through which a bolt extends for attaching an elongate cross member, which may have, for example, a C- or Z-shaped cross-section. The shortness in length of the individual deck support brackets allows access to the cross member-attaching bolt or nut from the open end of the extruded bracket. The cross members extend between the pontoons, generally perpendicular to the longitudinal axes thereof, the lower surface of each cross member abutting the upper support surfaces of a set of laterally-aligned deck support brackets. The plyboard deck members are then disposed upon the upper surfaces of the cross members and attached thereto by means of, for example, adhesive and bolts. Depending on the length of the boat, or the desired structural strength thereof, a different number and/or spacing of cross members may be required, in turn requiring, in previous pontoon boats, varying numbers and longitudinal spacings of deck support brackets.

The spacing and number of the short, individual deck support brackets along the length of the pontoon boat depend on the required spacing and number of cross members, which vary with the length of the boat being manufactured and/or its desired structural strength. Thus it can be readily appreciated by those skilled in the art that pontoon boats of differing lengths require a different number and/or placement of the individual deck support brackets along the length of each pontoon, thereby requiring unique weld fixturing for each length boat. Further, if additional cross members or a different placement of cross members are desired, then additional individual deck support brackets must be attached to the pontoons or the distribution scheme of the brackets along the pontoons must be revised. Either of which requires unique weld fixturing and perhaps additional labor. Moreover, because each individual deck support bracket is separately welded to its respective pontoon, a great number of welds may be required to attach the requisite number of brackets. A way of accommodating varying pontoon craft lengths with deck support brackets requiring simple weld fixturing, fewer welds and less labor is desirable.

As viewed from the outboard side of previous pontoon boats, the plurality of short, individual deck support brackets, perhaps irregularly spaced along a pontoon, and the attaching welds associated therewith, are rather unsightly. A way of improving the appearance of a pontoon craft by providing a continuous deck support bracket which extends along substantially the entire length of a pontoon while allowing access to the cross member-attaching fasteners, and covering the bracket-attaching welds is also desirable.

A plurality of short, individual deck support brackets attached along the length of a pontoon, may also provide less rigidity to the craft than is desired, and may also induce undesirably high stresses at localized points along a pontoon. A way of adding rigidity to the pontoon craft while spreading stresses more evenly along the pontoons is also desireable.

SUMMARY OF THE INVENTION

The present invention permits a variable number of cross members to be variably placed along the length of a pontoon craft such as a boat, a floating platform or a floating dock. A deck support bracket according to the present invention has an easily variable length to accommodate pontoon craft of different lengths, and provides a means of quickly and easily attaching cross members thereto in any number and at any position along a pontoon. Further, the inventive deck support bracket continuously extends along substantially the entire length of a pontoon, providing improved appearance while allowing access to the cross member-attaching fasteners, and additionally provides a means of quickly, easily and inexpensively covering the unsightly welds which attach the brackets to the pontoons. Because the inventive brackets extend continuously along the length of the pontoon, the stresses imparted thereto are more evenly distributed therealong than with individual deck support brackets, and increases the rigidity of the craft as well.

The present invention provides a pontoon craft having at least two pontoons, a deck extending between two of the pontoons, an elongate deck support bracket attached to a pontoon and having a longitudinal slot which extends substantially the entire length of the bracket, and a fastener extending through the slot and having a variable position along the slot, wherein said deck is connected to the bracket by means of the fastener.

The present invention also provides a pontoon craft having at least two pontoons, a deck extending between two of the pontoons, an elongate deck support bracket having a longitudinal slot, the bracket attached to a surface of a pontoon at a joint, and an elongate trim member disposed in said slot, the trim member depending from the slot and covering the joint, whereby the joint is hidden from view.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
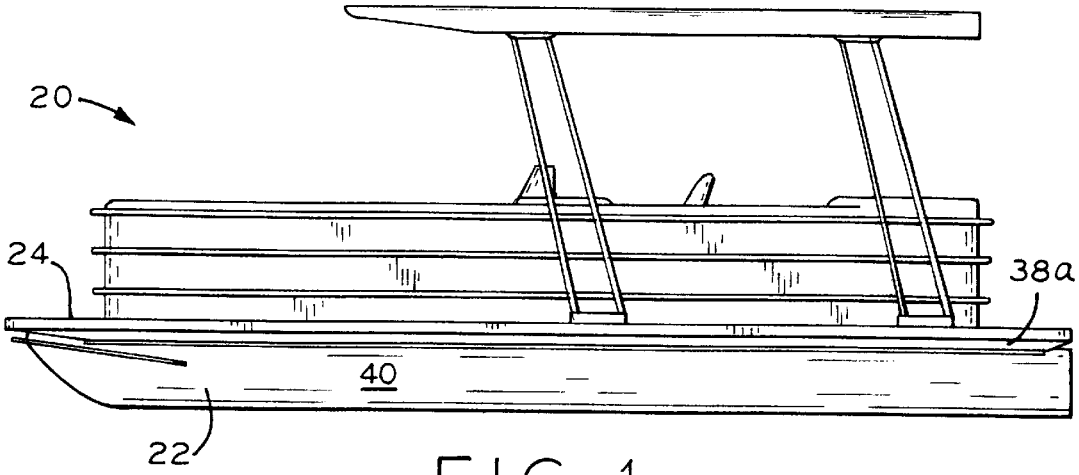
FIG. 1 is an elevational view of an embodiment of a pontoon boat according to the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention in one form, and such exemplification is not to be construed as limiting the scope of the invention in any manner.

DETAILED DESCRIPTION OF THE INVENTION

As a vessel, boat 20 of FIG. 1 represents but one embodiment of a pontoon craft according to the present invention. Boat 20 comprises, inter alia, a pair of elongate, parallel pontoons 22 (one of which is shown in FIG. 1). It should be understood, however, that an inventive pontoon vessel otherwise similar to boat 20 may have more than two pontoons 22. For example, it is envisioned that a craft according to the present invention may comprise three pontoons, the third of which lies intermediate and parallel with the above-described pair of pontoons 22. In the depicted embodiment, each of pontoons 22 is generally cylindrical although they may instead have another cross-sectional shape.

Figure 2:
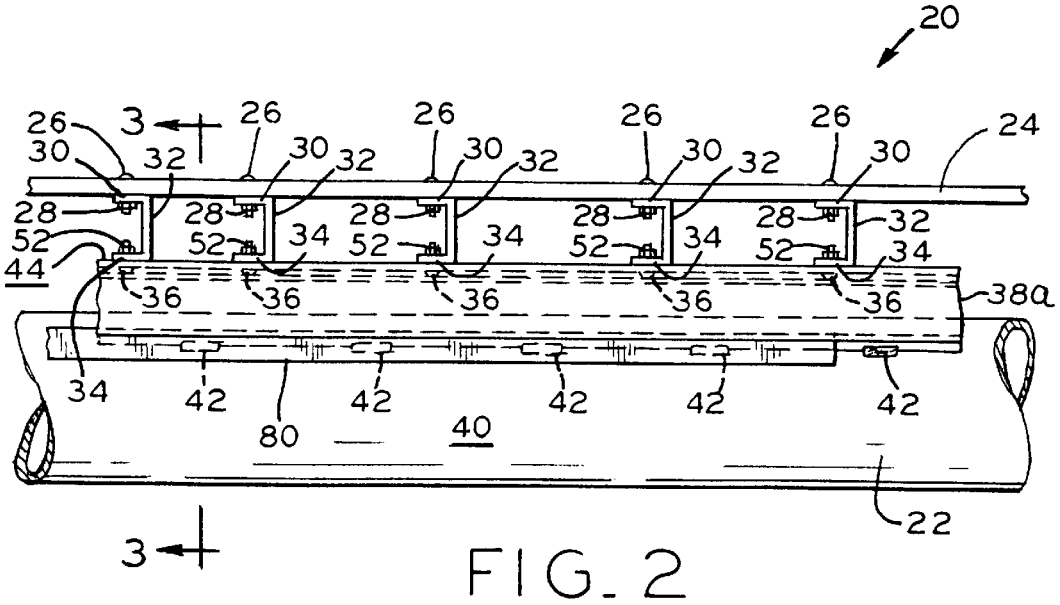
FIG. 2 is an enlarged, fragmentary view of the pontoon boat of FIG. 1, showing the inventive deck support bracket.
Figure 3:
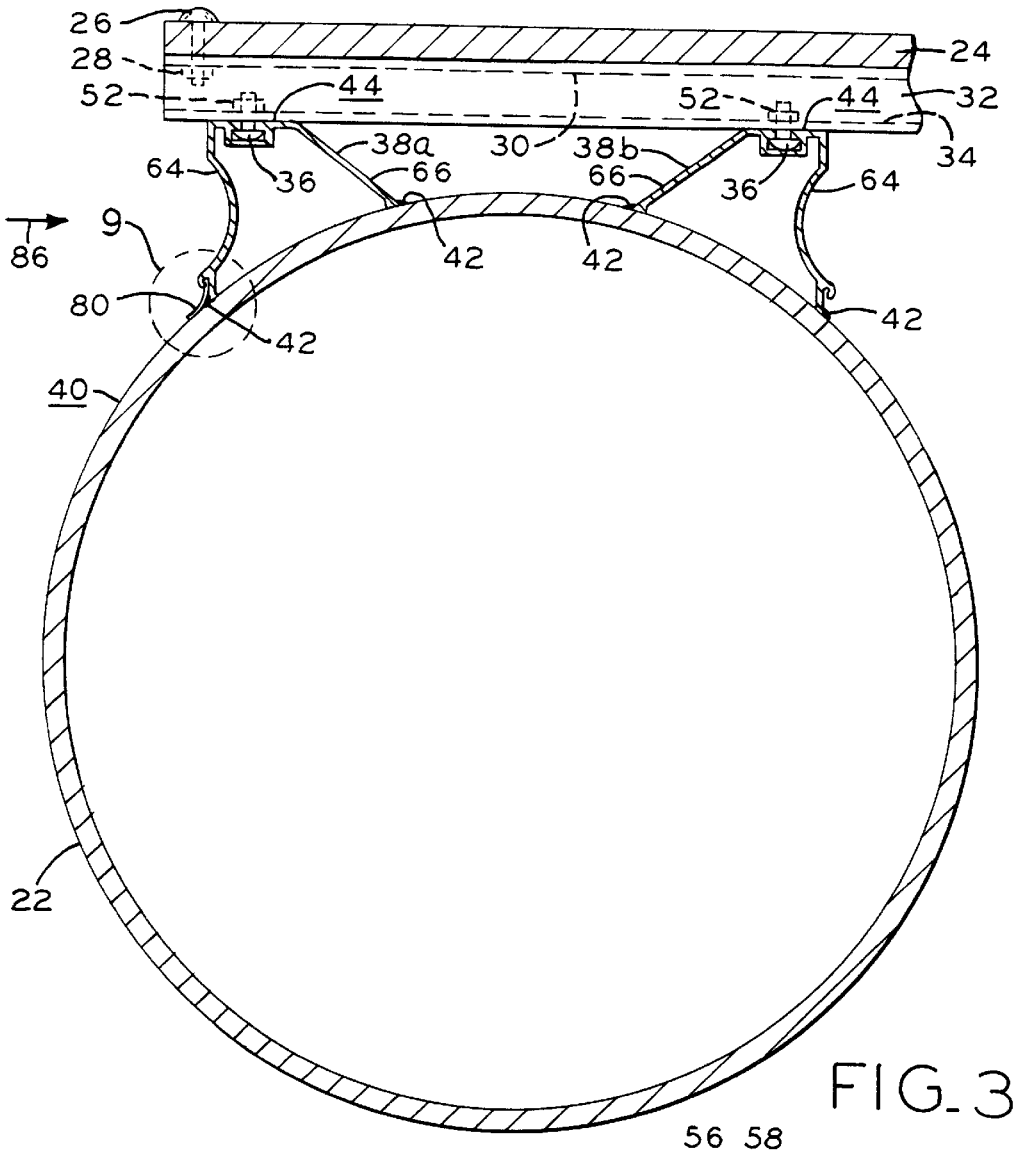
FIG. 3 is an enlarged, fragmentary sectional view of the pontoon boat portion shown in FIG. 2, along line 3—3.

Boat 20 also comprises deck 24 which extends substantially along the entire length of the pair of pontoons 22 and therebetween. Referring to FIGS. 2 and 3, deck 24 is attached by bolts 26, nuts 28 and adhesive (not shown) to upper flange 30 of each cross member 32. In lieu of bolts 26 and nuts 28, deck 24 may be attached to upper flange 30 by means of tek screws (not shown), which are self-tapping screws provided with a drill point tip.

Cross members 32 extend generally perpendicularly to the longitudinal axes of pontoons 22, and may have a C- or Z-shaped cross-section, or a mixed combination thereof. C-shaped cross members provide improved appearance at the bow and stem of a boat such as boat 20, while Z-shaped cross members provide easier access to attaching fasteners. Apertures (not shown) are provided in upper cross member flanges 30 and in deck 24 to accommodate bolts 26. Apertures (not shown) are also provided in lower flanges 34 of cross members 32 for accommodating bolts 36 which attach the cross members to deck support brackets 38, as discussed herein below.

As shown in FIGS. 2 and 3, each pontoon 22 is provided with identical deck support brackets 38. Deck support bracket 38*a* is disposed on the outboard side of starboard pontoon 22, whereas deck support bracket 38*b*, identical to bracket 38*a*, is disposed on the inboard side of starboard pontoon 22. Although not shown in the accompanying drawings, port side pontoon 22 is similarly provided with inboard and outboard deck support brackets 38*c*, 38*d*. It is to be understood that the port side pontoon 22 would be positioned to the right of starboard side pontoon 22 as viewed in FIG. 3. Thus, it can be readily envisioned that each cross member 32 extends between, and generally perpendicular to the longitudinal axes of, starboard and port side pontoons 22, and lies atop deck support brackets 38*a*–*d*. Each deck support bracket 38 is attached to outer surface 40 of pontoon 22 by means of a plurality of regularly spaced welds 42. In the shown embodiment, deck support bracket 38 is an extruded aluminum member, and pontoon 22 is also aluminum; hence, welds 42 are preferably metal/inert gas (MIG) welds.

Figure 10:
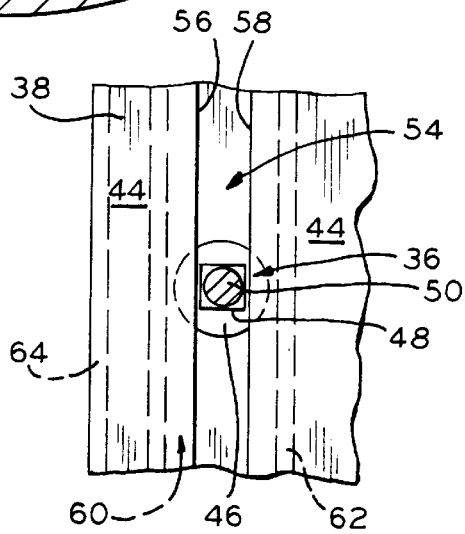
FIG. 10 is a sectional top view of the bracket and bolt of FIG. 5, along line 10—10.
Figure 5:
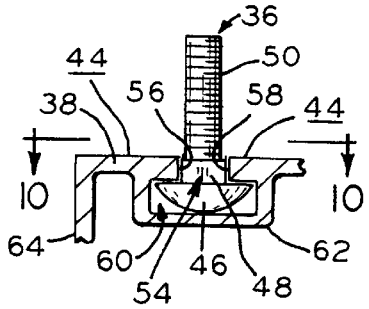
FIG. 5 is a slightly enlarged, fragmentary sectional end view of the bracket of FIG. 4, within encircled portion 5, additionally showing a carriage bolt within its receiving slot.
Figure 6:
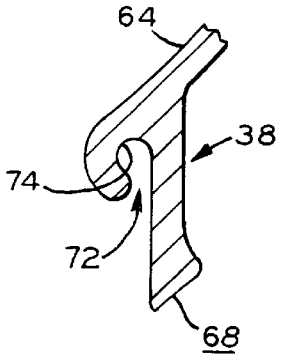
FIG. 6 is an enlarged, fragmentary sectional end view of the bracket of FIG. 4, within encircled portion 6.

As best seen in FIG. 3, lower cross member flange 34 abuts upper mounting surface 44 of deck support bracket 38. As mentioned above, each cross member 32 is attached to each deck support member 38 by means of bolt 36. Referring to FIGS. 5 and 10, bolt 36 is an ordinary carriage bolt having rounded head 46, square shank 48 and elongate threaded portion 50. Nut 52 (FIGS. 2, 3) is threadedly received on portion 50 of bolt 46.

Figure 4:
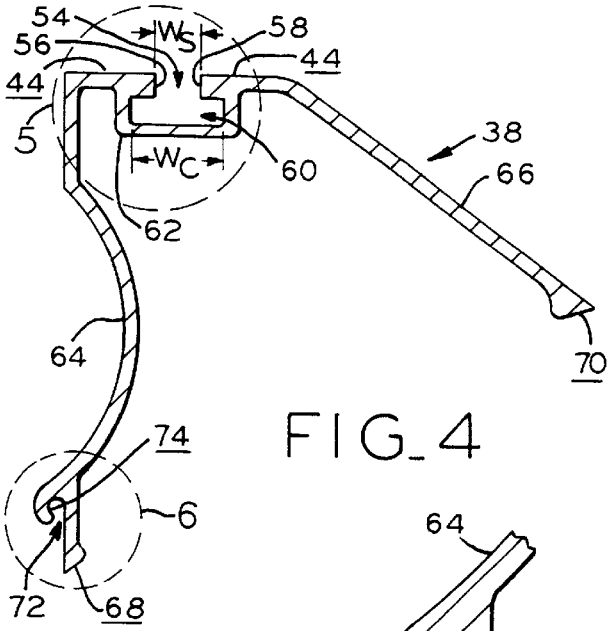
FIG. 4 is a sectional end view of the inventive deck support bracket.

As shown in FIG. 4, upper mounting surface 44, which extends the entire length of bracket 38, has provided therein longitudinal slot 54 having opposed sides 56, 58, defining slot width $w_s$. Bracket 38 provides, below slot 54, longitudinal channel 60 having width $w_c$which is greater that slot width $w_s$. Walls 62 of channel 60 are formed in extruded bracket 38, and both slot 54 and channel 60 extend the entire length of the bracket. Because slot 54 and channel 60 extend the entire length of bracket 38, which itself extends substantially the entire lengths of pontoons 22, it can be easily visualized that the number of bolts 36 and cross members 32, and their placement along the length of boat 20 may be varied without altering the number of brackets 38 necessary. Bolts 36 are fed into the slot and channel of bracket 38 from an end thereof; bolt head 46 is slidably disposed in channel 60, while bolt shank 48 is slidably disposed within slot 54; threaded portion 50 extends upwardly from surface 44 and cross member 32 is assembled thereto with nuts 52. Opposed sides of square shank 48 respectively slide along slot sides 56, 58, and abutting contact between the shank and slot sides prevents bolt 36 from rotating relative to bracket 38. In lieu of carriage bolts 36, rectangular-headed (e.g., square-headed) bolts or T-bolts (not shown) may alternatively be used, the heads thereof prevented from rotating by abuttingly contacting the opposite channel walls 62, the threaded portions thereof extending upwards through slot 54.

The spacing between cross members 32 may be easily varied by merely sliding the cross member to its desired position, and tightening nut 52 onto carriage bolt 36. Alternatively, instead of inserting bolts into channel 60 from the end thereof, one or more circular reliefs (not shown) may be provided in surface 44 centrally or at various positions along the length of slot 54, centered laterally thereon, through which head 46 of bolt 36 may be inserted into channel 60; bolts 36 then slid from the relief location to their deck-mounting positions along bracket 38.

Because bracket 38 is an aluminum extrusion, its length may be altered to accommodate any pontoon length, and it may be attached to pontoon 22 with only as many welds as necessary to provide adequate attachment, rather than requiring the number of welds to be determined by a large number of short, individual deck support brackets as in previous pontoon boats. Should extrusion lengths be unavailable to provide a single-piece bracket 38, the bracket may alternatively be formed from shorter, abutting lengths of the aluminum extrusion.

As shown in FIG. 4, deck support member 38 has two legs 64, 66, the respective end surfaces 68, 70 of which abut outer pontoon surface 40 to form a joint which extends along the interfacing surfaces. Welds 42 are placed along these joints, attaching legs 64, 66 to the pontoons. Legs 64, 66 depend from upper mounting surface 44, giving bracket 38 a generally inverted U-shaped cross-section, although given the cross-sectional dip provided by channel walls 62, bracket 38 may be said to have a somewhat M-shaped cross-section. In embodiments of the inventive comprising more that two pontoons, for example a boat (not shown) having a third pontoon between the pair of pontoons 22, the third pontoon would be provided with a pair of deck support brackets 38 in the above-described manner, cross members 32 attached thereto.

Figure 7:
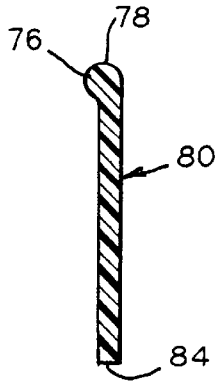
FIG. 7 is an enlarged sectional end view of a flexible trim member.
Figure 8:
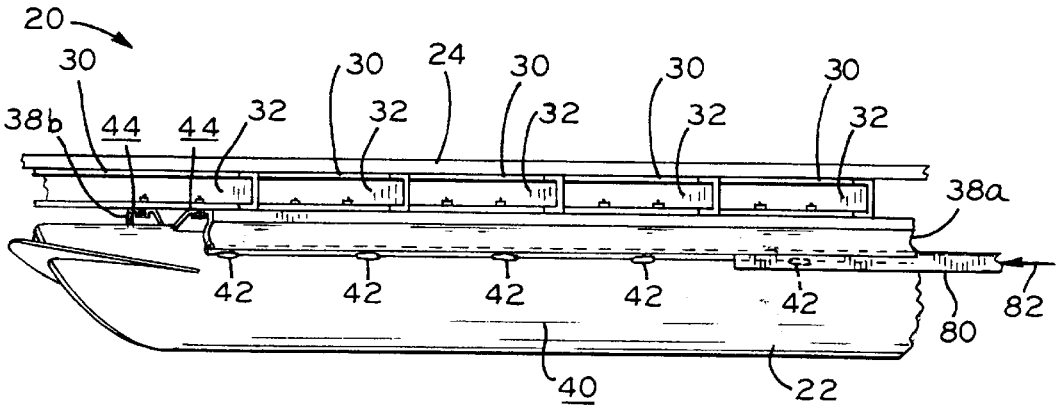
FIG. 8 is a fragmentary, perspective view of the pontoon boat of FIG. 1 showing the installation of the flexible trim member of FIG. 7.

Referring again to FIG. 4, it can be seen that leg 64 of deck support bracket 38 is provided with longitudinal slot 72 which extends the entire length of the bracket and opens generally downwardly. Inner wall surface 74 of slot 72 is partially cylindrical, extending circumferentially more than 180° to form an encircling grip about generally cylindrical bead 76 formed on upper edge 78 of flexible, extruded trim member 80 (FIG. 7) which is slidably received in slot 72. Although inner slot wall surface 74 and corresponding trim member bead 76 are, in the shown embodiment, generally cylindrical, other shapes can be accommodated, by varying the corresponding cross-sectional shapes of the trim member bead and the receiving bracket slot. Referring to FIG. 8, beaded upper edge 78 of trim member 80 is slid in the direction of arrow 82 into slot 72 from one end of bracket 38, and is retained therein by the interference fit between bead 76 and the underlying lip of slot surface 74. Thus, trim member depends from slot 72, its lower edge 84 well below the joint formed between end surface 68 of bracket let 64 and outer pontoon surface 40, covering welds 42. Notably, as shown in FIG. 3, only outwardly facing leg 64 of outboard bracket 38*a*, visible in the direction of arrow 86, need be provided with trim member 80, for welds 42 attaching inboard bracket 38*b* will ordinarily be hidden from view. Similarly, on the port side of boat 20 (not shown), only the outboard bracket 38 need be provided with trim member 80. It will be immediately recognized, however, that although its welds 42 are ordinarily hidden from view, slot 72 of inboard brackets 38 may also be provided with trim member 80.

By covering outward facing welds 42, trim member 80 provides boat 20 with improved appearance and higher levels of perceived quality. Trim member 80 is provided in long, continuous strips, perhaps in bulk on a reel, and may be made of PVC or another suitable, flexible material. Further, trim member 80 may be provided in colors which contrast, complement or match the aluminum deck support brackets and pontoons. Further still, in addition to providing a means for providing a variable number of variably positionable cross members, the continuous, solid appearance of bracket 38 extending along pontoons 22 provides boat 20 with cleaner lines vis-a-vis previous pontoon boats comprising a plurality of individual, visible deck support members, which may be spaced at irregular intervals.

Figure 9:
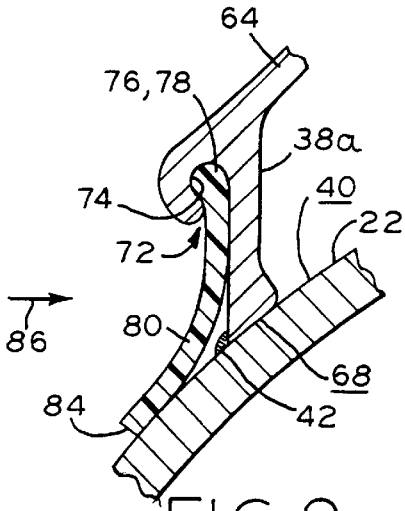
FIG. 9 is an enlarged, fragmentary sectional view of the bracket of FIG. 6 attached to a pontoon, with trim member of FIG. 7 in its installed position.

FIG. 9 shows a cross-sectional view of trim member 80 installed in its receiving bracket slot 72. In the shown embodiment, flexible trim member 80, once installed, preferably assumes a curved shape, depending substantially vertically from slot 72, but curving outwardly to conform to pontoon surface 40, well-covering welds 42. Further, in curving outwardly as shown, trim member 80 provides a graceful transition from generally vertically depending bracket leg 64 to the cylindrical surface of pontoon 22.

While this invention has been described as having an exemplary design, the present invention may be further modified within the spirit and scope of this disclosure. This application is, therefore, intended to cover any variations, uses, or adaptations of the invention using its general principles. For example, it is intended that a vessel such as boat 20, a floating platform and a floating dock each lie within the scope of this disclosure and are to be interpreted as being pontoon craft. Further, this application is intended to cover such departures from the present disclosure as come within known or customary practice in the art to which this invention pertains. Accordingly, the scope of the invention should be determined not by the illustrated embodiments but by the following claims and their legal equivalents.

What is claimed is:

1. A pontoon craft comprising:

at least two longitudinal pontoons;

a deck extending between two of said pontoons;

a pair of elongate deck support brackets attached respectively to said pontoons, each said bracket having a longitudinal slot which extends substantially the entire length of said bracket, said brackets extending generally parallel to said pontoons; and a plurality of selectively tightenable fasteners extending upwardly through said slot of each said bracket and slidable therealong to thereby have a variable position along said slot;

said fasteners connected to said deck whereby said deck may be fixedly connected to said brackets at variable longitudinal positions along said pontoons.

2. The pontoon craft of claim 1, further comprising means for preventing rotation of each said fastener.

3. The pontoon craft of claim 2, wherein said means for preventing rotation of each said fastener comprises a substantially flat surface of said fastener engaging an adjacent surface of the respective said bracket.

4. The pontoon craft of claim 1, wherein said deck comprises a deck cross member extending between said two of said pontoons, said deck cross member attached to a said deck support bracket by means of a said fastener.

5. The pontoon craft of claim 1, wherein each said bracket is an aluminum extrusion.

6. The pontoon craft of claim 1, wherein each said bracket comprises an inner leg and an outer leg, each said leg having an end attached to an outer surface of a respective said pontoon.

7. The pontoon craft of claim 1, wherein each said bracket leg end is attached to said pontoon by at least one weld.

8. The pontoon craft of claim 6, wherein said pontoon craft is a vessel.

9. The pontoon craft of claim 1, wherein said pontoon craft is a floating platform.

10. The pontoon craft of claim 1, wherein said pontoon craft is a floating dock.

11. A pontoon craft comprising:

at least two pontoons;

a deck extending between two of said pontoons;

an elongate deck support bracket having a longitudinal slot and attached to a surface of a said pontoon at a joint; and an elongate trim member disposed in said slot, said trim member depending from said slot and covering said joint, whereby said joint is hidden from view.

12. The pontoon craft of claim 11, wherein said joint is substantially linear.

13. The pontoon craft of claim 12, wherein said bracket is attached to a said pontoon surface by means of at least one weld along said joint.

14. The pontoon craft of claim 13 wherein said trim member overhangs said weld, whereby said weld is hidden from view.

15. The pontoon craft of claim 11, wherein said slot and said trim member each substantially extend the entire length of said elongate deck bracket.

16. The pontoon craft of claim 11, wherein said bracket is substantially M-shaped and has outer and inner legs, each said leg having and end attached to a said pontoon surface at a joint.

17. The pontoon craft of claim 16, wherein each said leg end is attached to a said pontoon surface by means of at least one weld long each joint.

18. The pontoon craft of claim 16, wherein each said joint is substantially linear.

19. The pontoon craft of claim 18, wherein each said joint is substantially parallel.

20. The pontoon craft of claim 16, wherein said slot is located proximal said outer leg end, said trim member covering said joint between said outer leg end and a said pontoon surface.

21. The pontoon craft of claim 11, wherein said bracket is an aluminum extrusion.

22. The pontoon craft of claim 11, wherein said elongate trim member is flexible.

23. The pontoon craft of claim 11, wherein said trim member has a longitudinal edge, said edge having a bead formed thereon, said bead slidably disposed in said slot.

24. The pontoon craft of claim 23, wherein said trim member edge is a first edge, said trim member having a second edge opposite and substantially parallel with said first edge, said first and second edges disposed on opposite sides of said joint, whereby said joint is shielded from view.

25. The pontoon craft of claim 11, wherein at least one bracket is attached to each said pontoon.

26. The pontoon craft of claim 25, wherein said deck is connected to each said bracket.

27. The pontoon craft of claim 26, wherein a plurality of cross members extend between said pontoons, intermediate said deck and said brackets, said deck attached to said cross members, said cross members attached to each said bracket.

28. The pontoon craft of claim 11, wherein said pontoon craft is a vessel.

29. The pontoon craft of claim 11, wherein said pontoon craft is a floating platform.

30. The pontoon craft of claim 11, wherein said pontoon craft is a floating dock.

31. A pontoon craft comprising:

at least two pontoons;

a deck extending between two of said pontoons;

at least one elongate deck support bracket attached respectively to each said pontoon and having a longitudinal channel which extends substantially the entire length of said bracket, said bracket comprising an inner leg and an outer leg, each said leg having an end attached to an outer surface of said pontoon by at least one weld, said bracket having a longitudinal first slot adjacent said channel, said bracket having a second longitudinal slot on its said outer leg;

an elongate trim member disposed in said second slot and extending from said second slot over said at least one weld attaching said outer leg end to said pontoon surface; and a fastener captured within said channel and slidable therealong to thereby have a variable position along said channel, said deck connected to said bracket by means of said fastener.

32. The pontoon craft of claim 31, wherein said trim member is flexible.

33. A pontoon craft comprising:

at least two pontoons;

a deck extending between two of said pontoons;

at least one elongate deck support bracket attached respectively to each said pontoon and having a longitudinal channel which extends substantially the entire length of said bracket, said bracket comprising an inner leg and an outer leg, each said leg having an end attached to an outer surface of said pontoon, said bracket having a longitudinal first slot adjacent said channel, said bracket having a second longitudinal slot on its said outer leg, and said outer leg is substantially downwardly depending;

a trim member disposed in said second slot and extending substantially downward and below said outer leg end; and a fastener captured within said channel and slidable therealong to thereby have a variable position along said channel, said deck connected to said bracket by means of said fastener.

34. A pontoon craft comprising:

at least two pontoons;

a deck extending between two of said pontoons;

at least one elongate deck support bracket attached respectively to each said pontoon, each said bracket having a longitudinal channel which extends substantially the entire length of said bracket; and at least one fastener captured within each said channel and slidable therealong to thereby have a variable position along the respective said channel, wherein said deck is connected to said brackets by means of said fasteners;

each said bracket having a longitudinal slot adjacent said channel, said channel having a width greater than a width of said slot, a respective said fastener extending through said slot into said channel;

wherein each said fastener is a threaded fastener having a portion non-rotatably locked in one of said slot and said channel, and a threaded portion extending from the respective said bracket.

35. The pontoon craft of claim 34, wherein each said fastener is a carriage bolt having a head, a threaded portion and a substantially square shank intermediate said head and said threaded portion, said head disposed in the respective said channel, said shank disposed in said slot, said shank in contact with opposed sides of said slot.

36. The pontoon craft of claim 34, wherein each said fastener is a bolt having a rectangular head and a threaded portion, said head disposed in the respective said channel and in contact with opposed sides of said channel.

37. The pontoon craft of claim 34, wherein each said pontoon has at least two said deck support brackets attached thereto.

* * * * *